US007841017B2

(12) United States Patent
Aoki

(10) Patent No.: US 7,841,017 B2
(45) Date of Patent: Nov. 30, 2010

(54) GLOVE

(75) Inventor: Akio Aoki, Osaka (JP)

(73) Assignee: Trion Corporation, Osaka (JP)

( * ) Notice: Subject to any disclaimer, the term of this patent is extended or adjusted under 35 U.S.C. 154(b) by 346 days.

(21) Appl. No.: 12/014,732

(22) Filed: Jan. 15, 2008

(65) Prior Publication Data

US 2008/0250540 A1 Oct. 16, 2008

Related U.S. Application Data

(63) Continuation-in-part of application No. 11/733,856, filed on Apr. 11, 2007, now abandoned.

(51) Int. Cl.
*A63B 71/14* (2006.01)

(52) U.S. Cl. ..... 2/19; 2/161.1; 2/161.6

(58) Field of Classification Search ..... 2/19, 2/161.1, 161.6, 160, 159, 16
See application file for complete search history.

(56) References Cited

U.S. PATENT DOCUMENTS 1,496,824 A * 6/1924 Nixon, Jr. ..... 2/19
4,038,787 A 8/1977 Bianchi
4,513,450 A * 4/1985 Aoki ..... 2/19
6,575,822 B2 6/2003 Lowe
6,618,860 B1 * 9/2003 Sullivan et al. ..... 2/159
6,912,731 B2 7/2005 Cass
2005/0066411 A1 * 3/2005 Matechen ..... 2/161.1
2006/0195968 A1 9/2006 Powell et al.

FOREIGN PATENT DOCUMENTS

JP 2002-153582 5/2002

* cited by examiner

*Primary Examiner*—Gary L Welch
*Assistant Examiner*—Alissa J Tompkins
(74) *Attorney, Agent, or Firm*—Knobbe Martens Olson & Bear, LLP

(57) ABSTRACT

A glove comprising a palm-side outer skin, a back-side outer skin, and a back-side inner skin, wherein a finger inserting space part into which a finger can be inserted between an inner surface of the back-side inner skin and an inner surface of the palm-side outer skin is constituted by sewing the back-side inner skin on an inner surface of the palm-side outer skin.

17 Claims, 18 Drawing Sheets

【Fig 1】
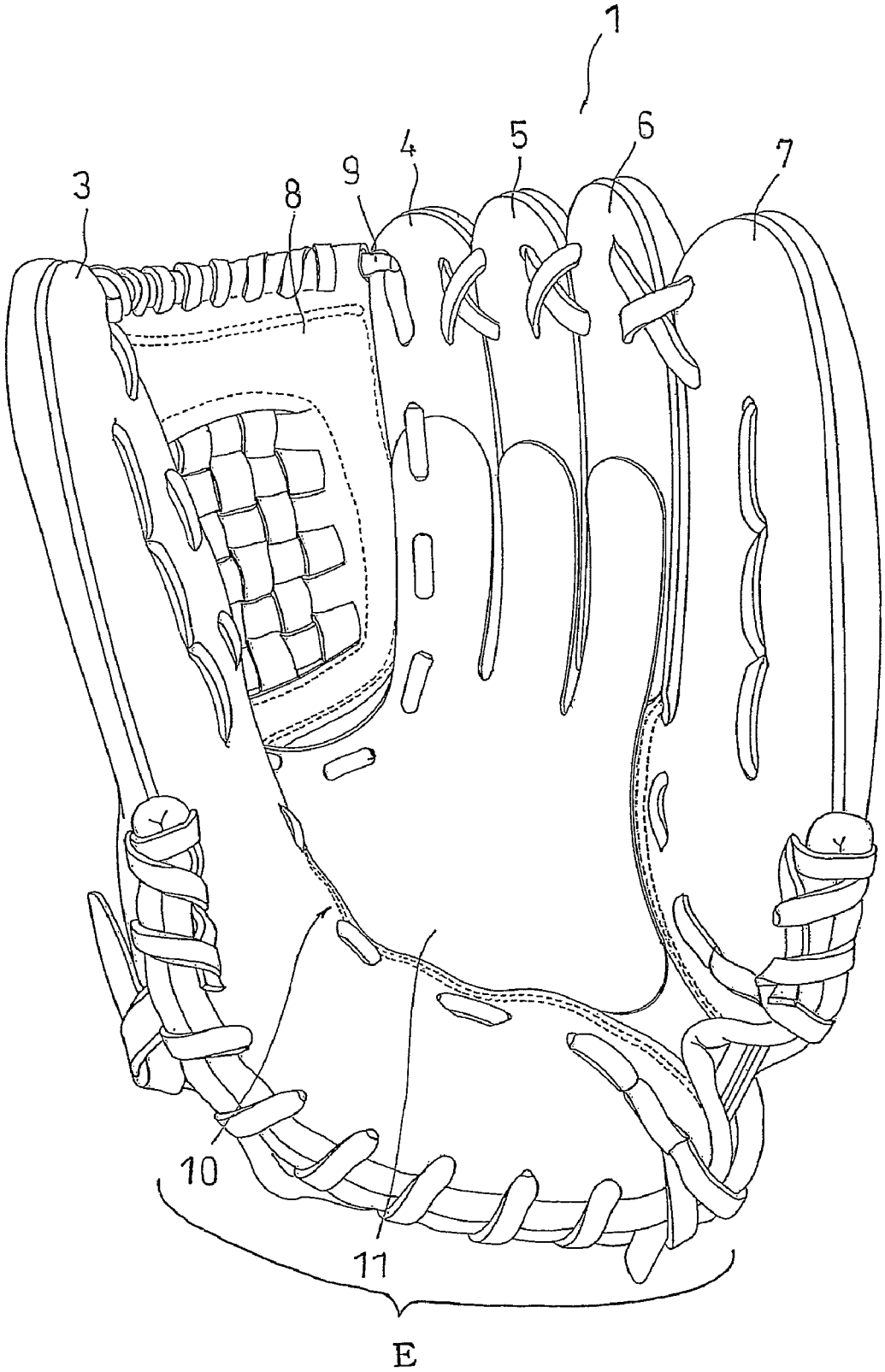

【Fig 2】
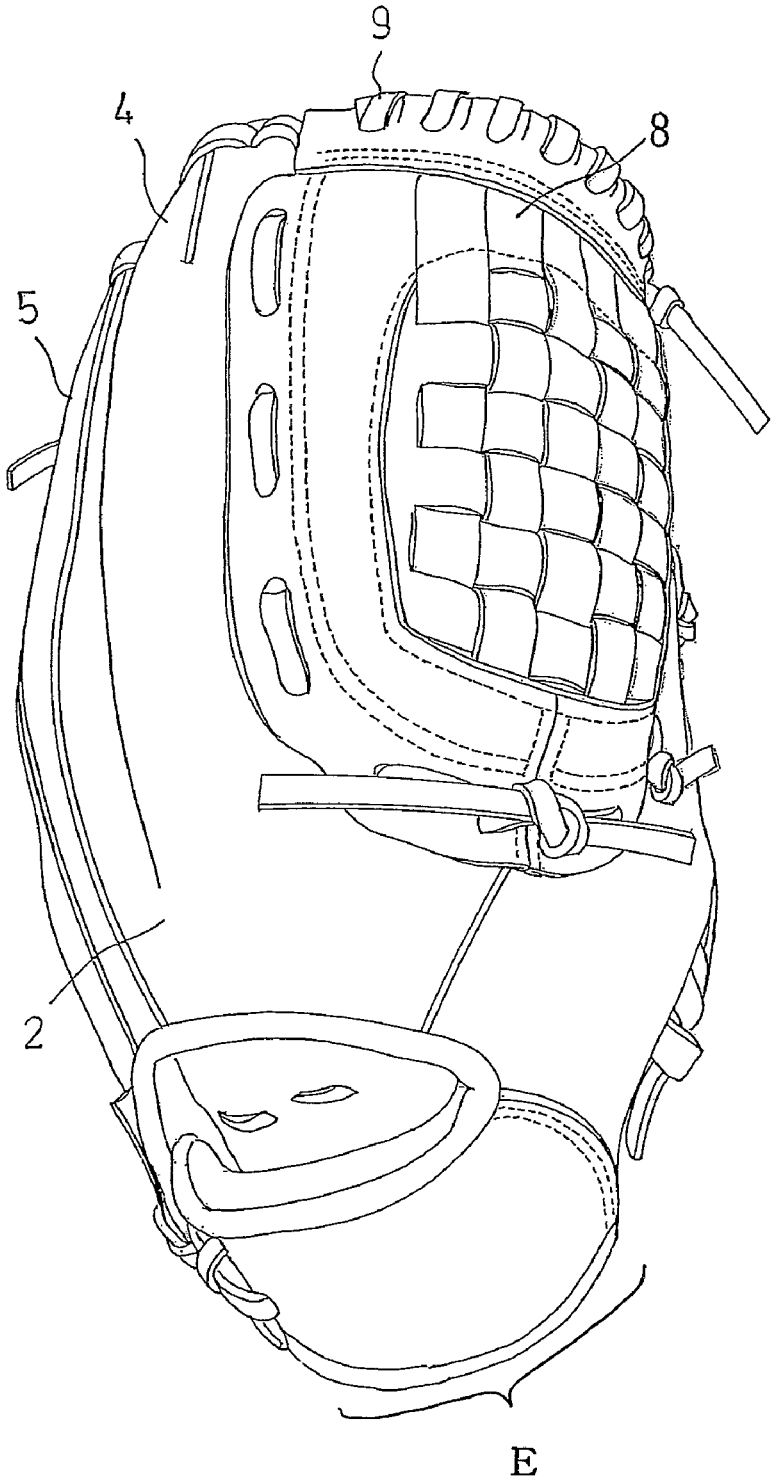

【Fig 3】
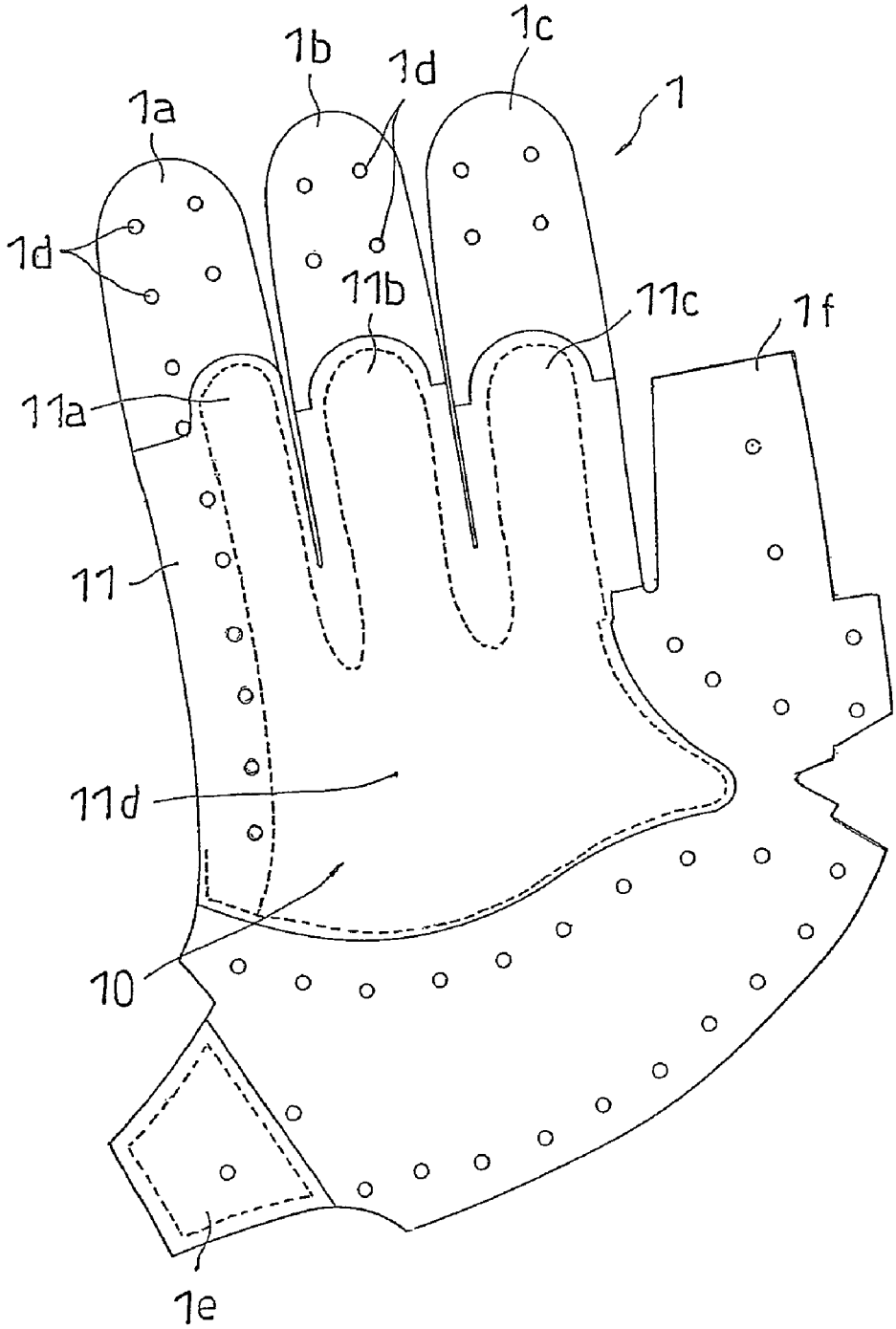

【Fig 4】
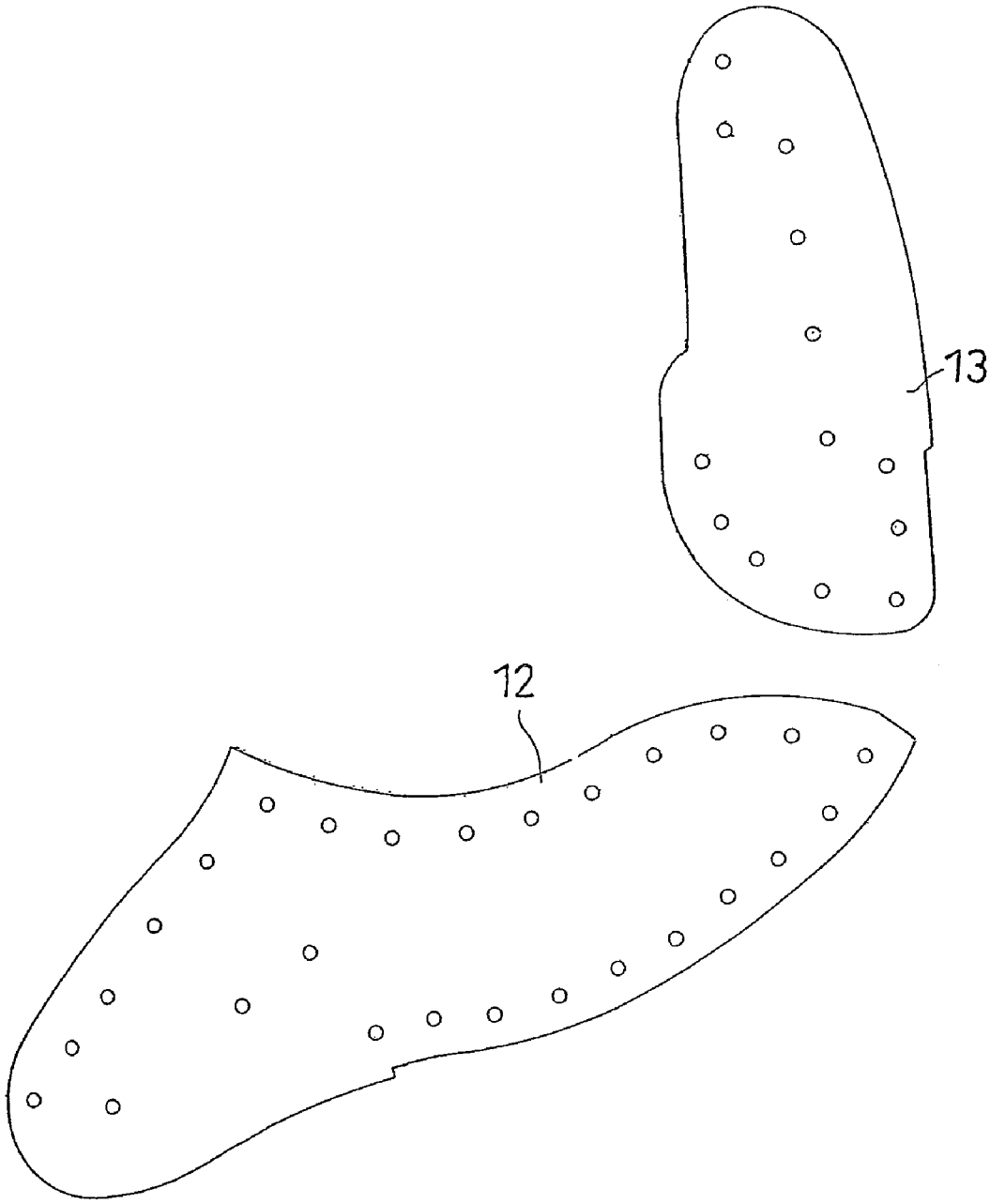

【Fig 5】
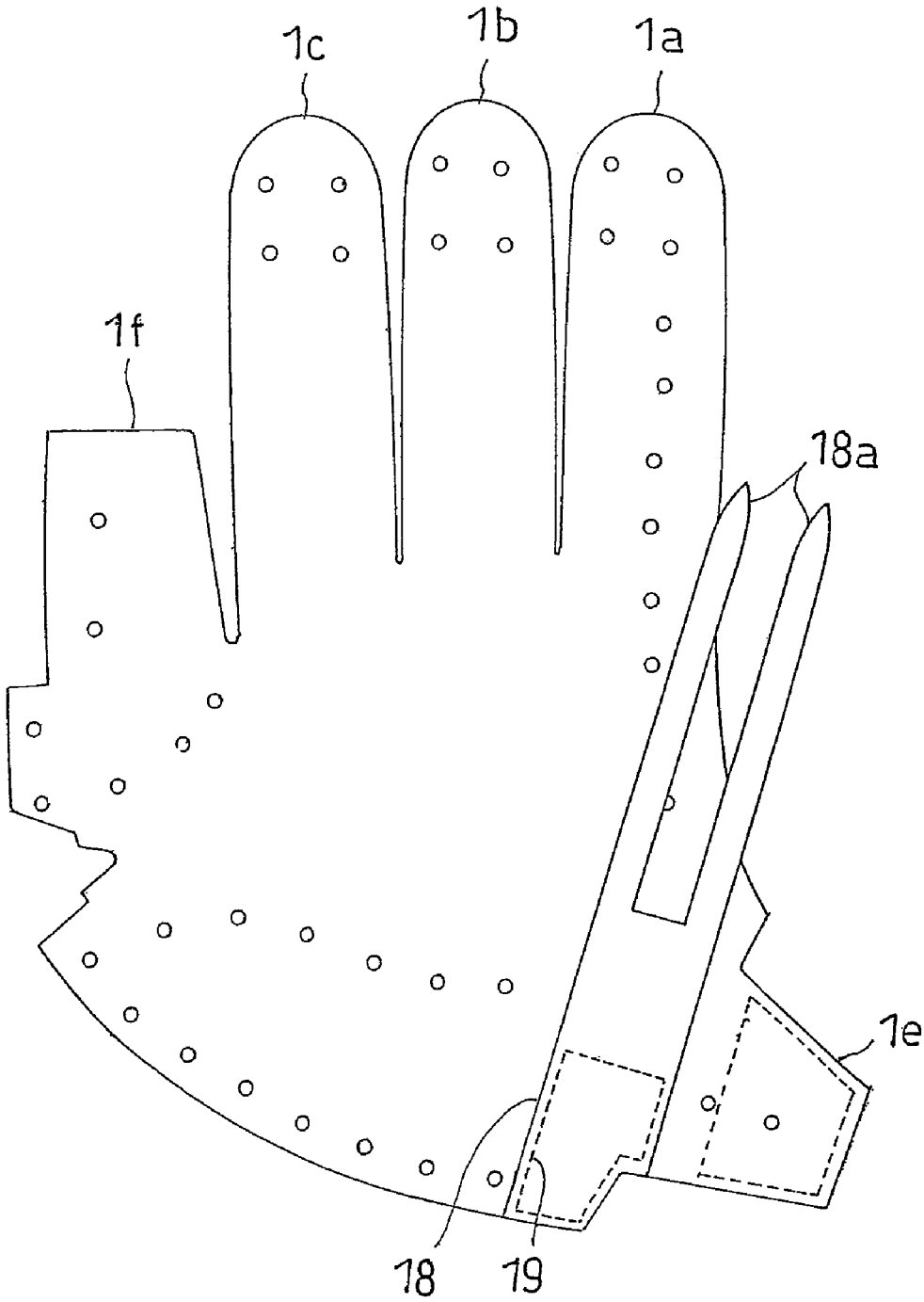

【Fig 6】
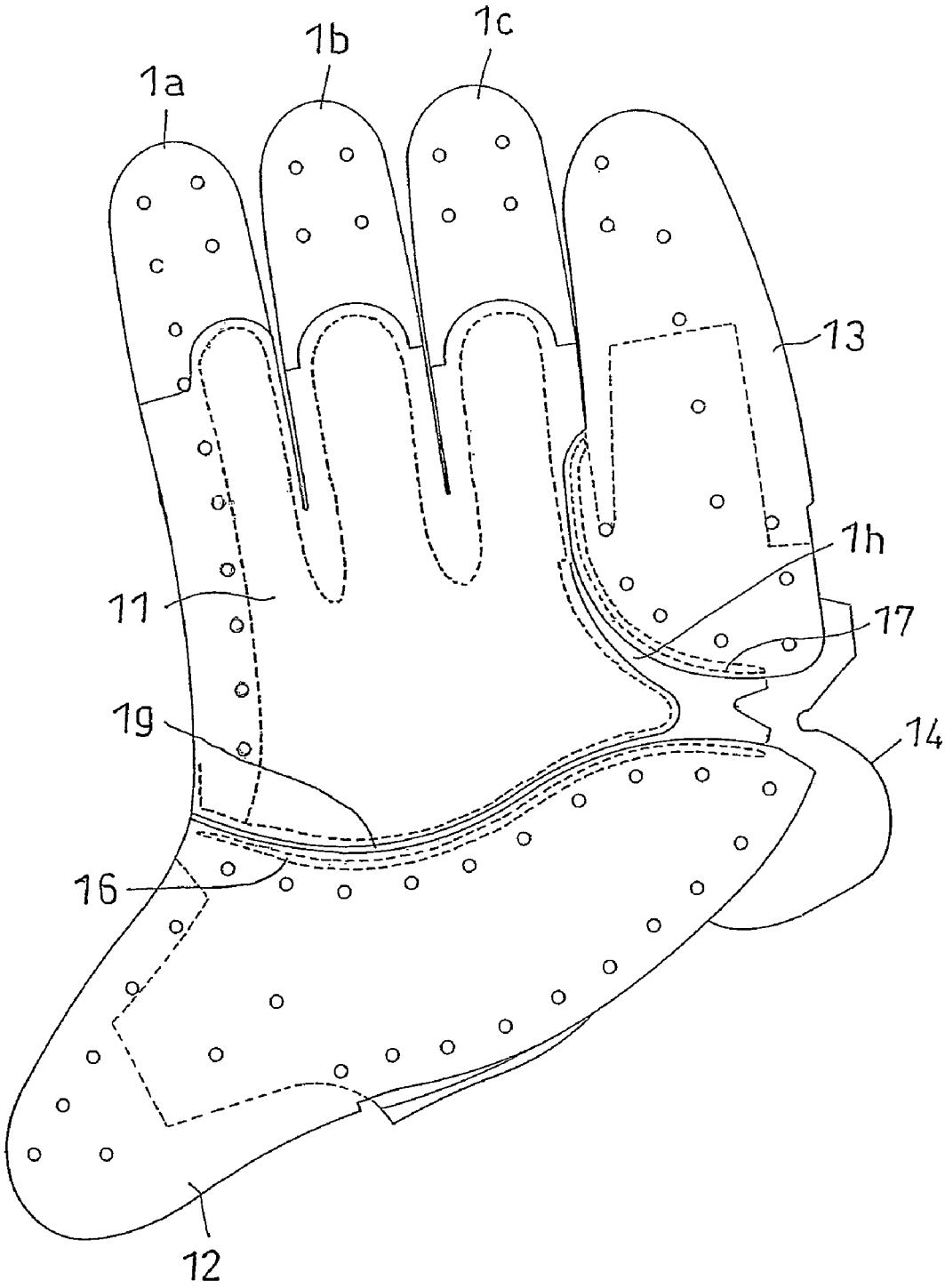

【Fig 7】
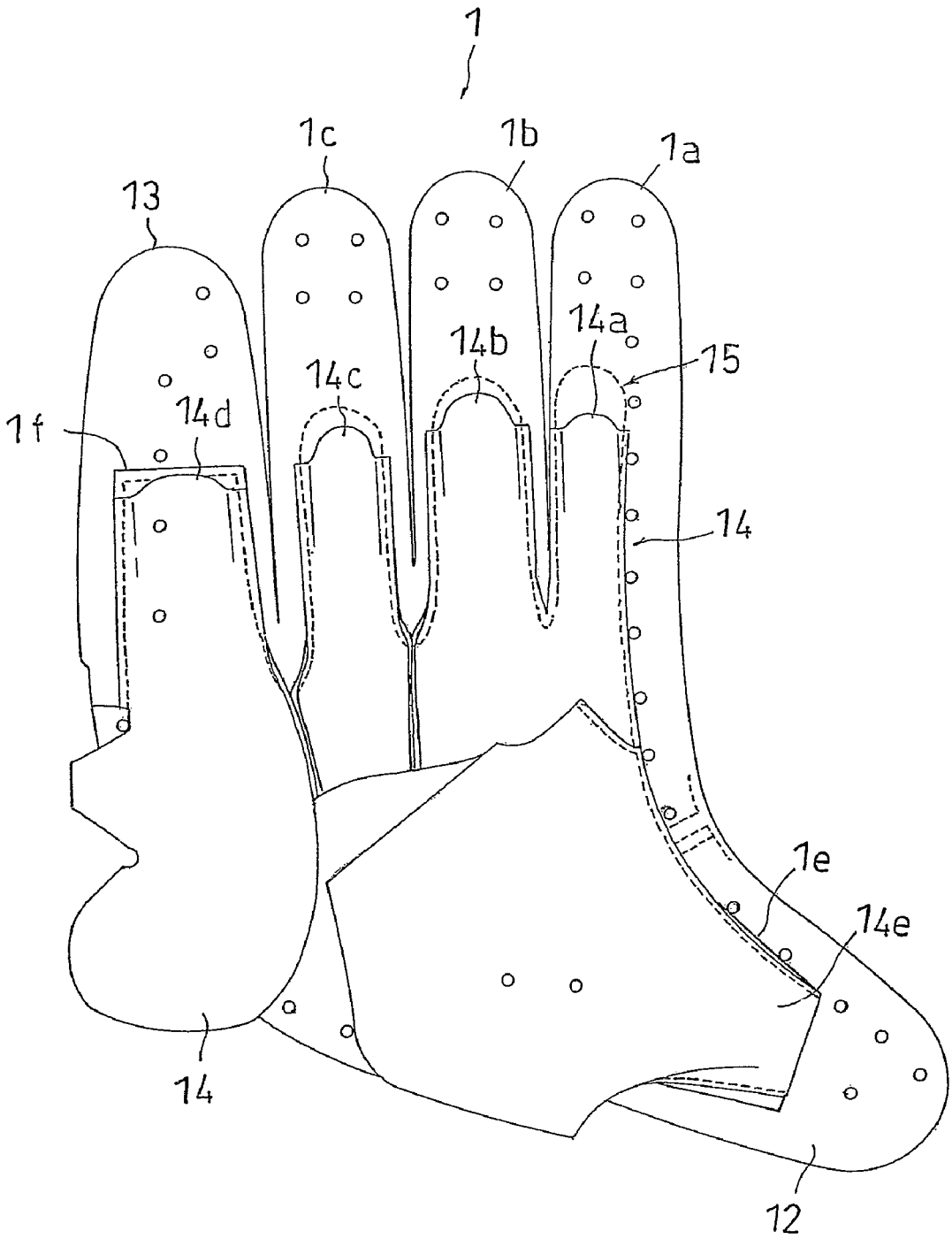

【Fig 8】
(a)
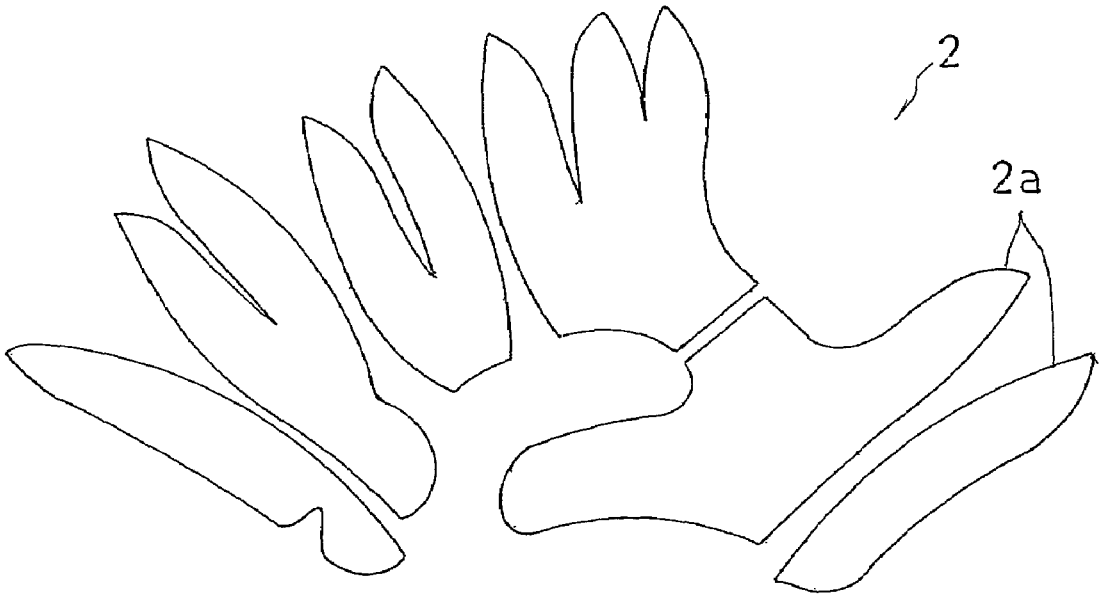
(b)
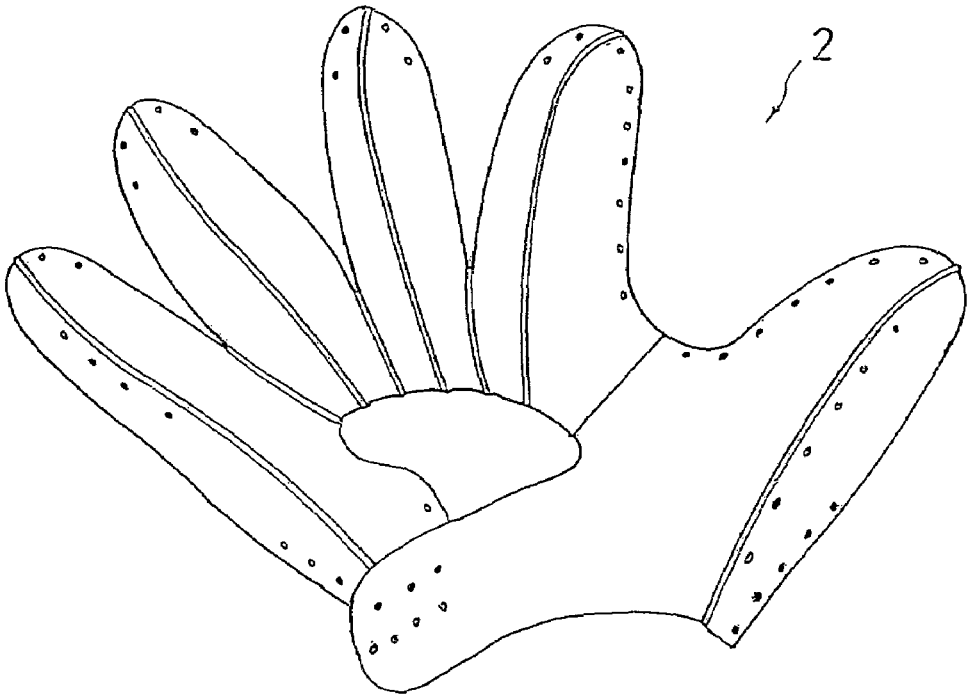

【Fig 9】
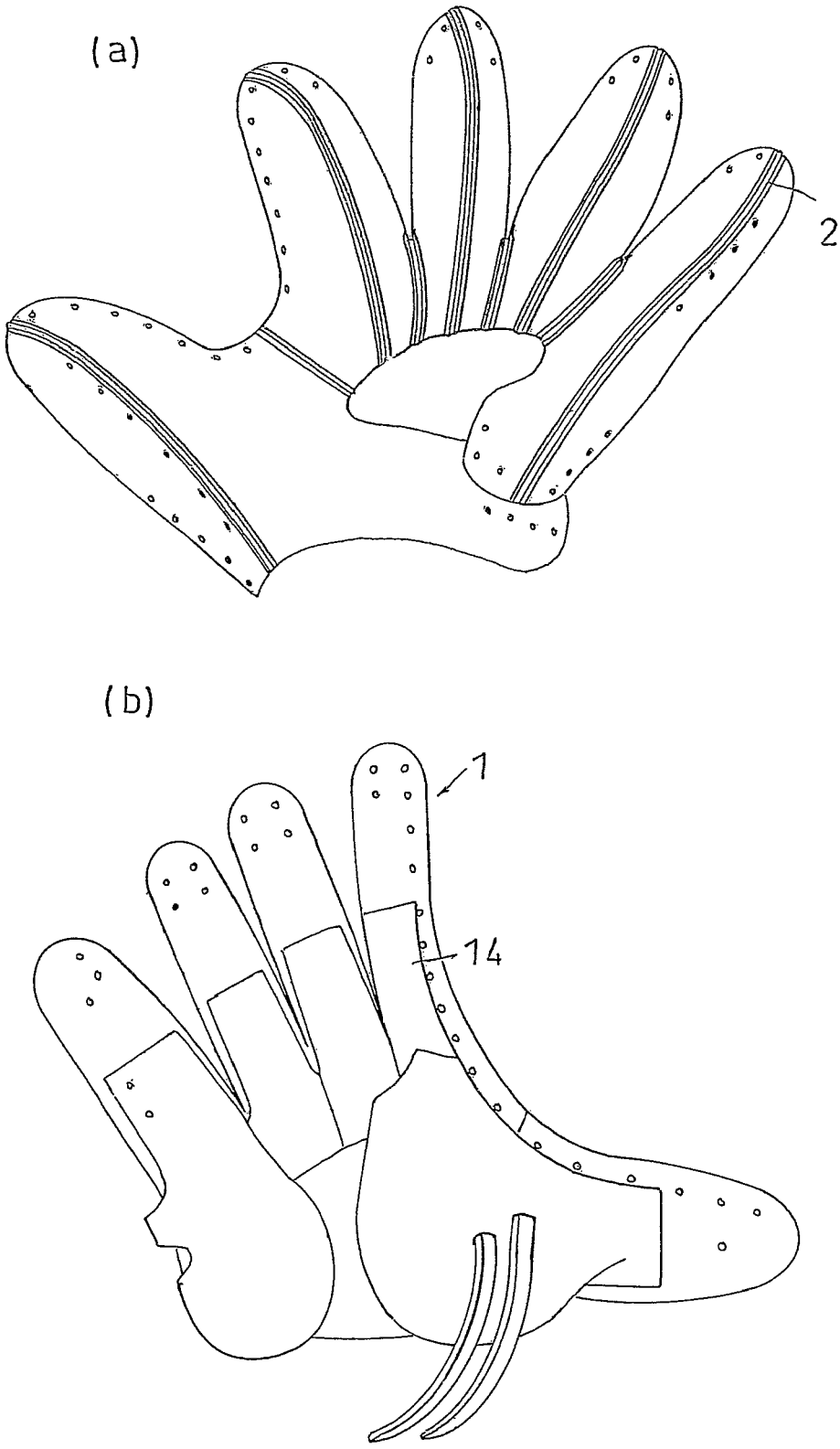

【Fig 10】
(a)
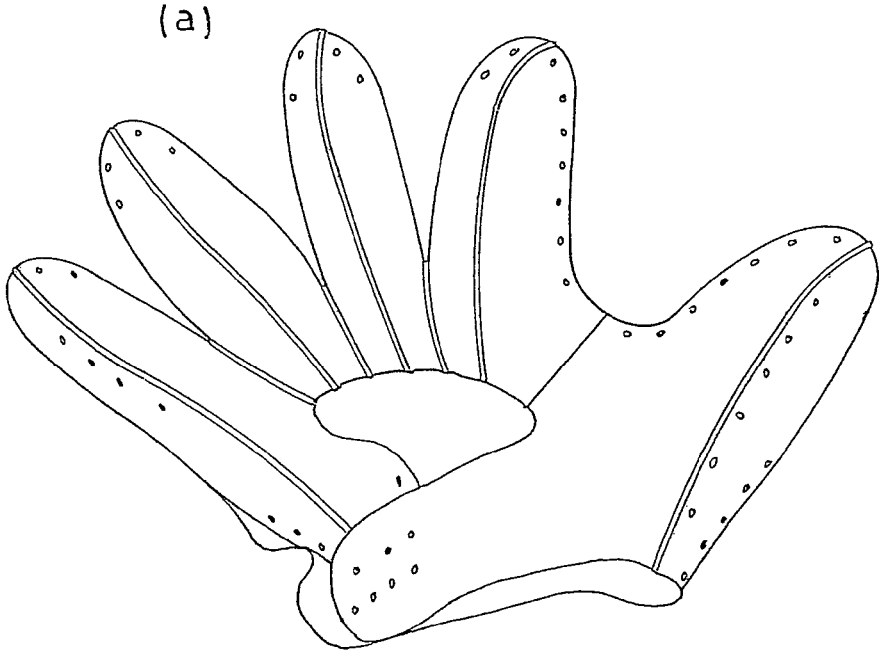
(b)
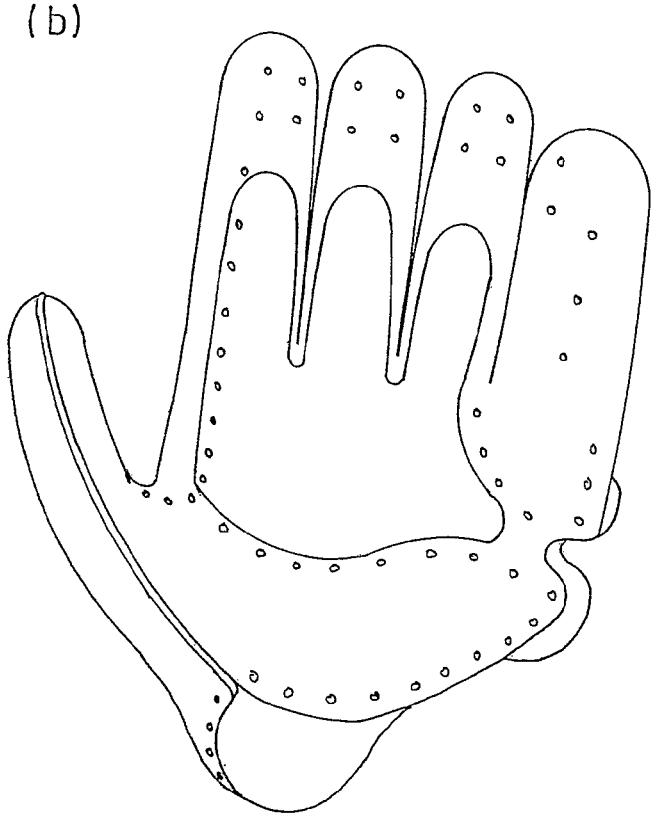

【Fig 11】
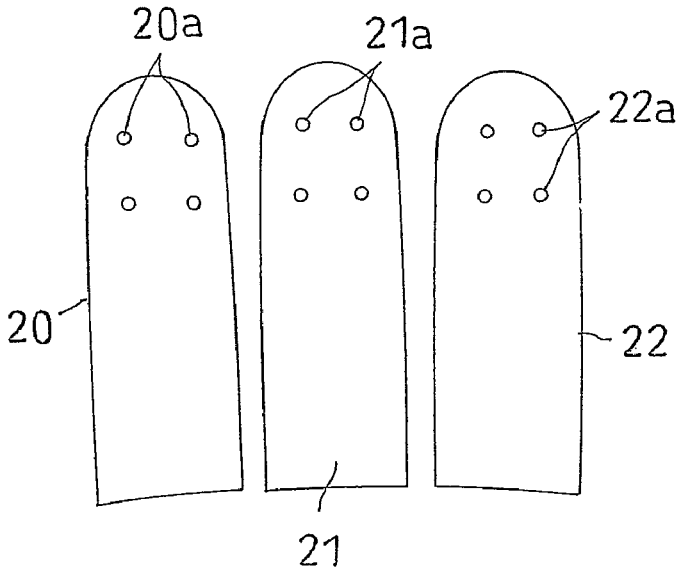
【Fig 12】
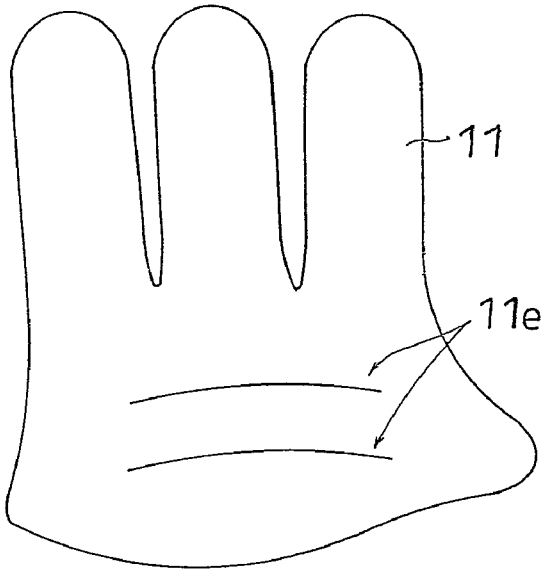

【Fig 13】
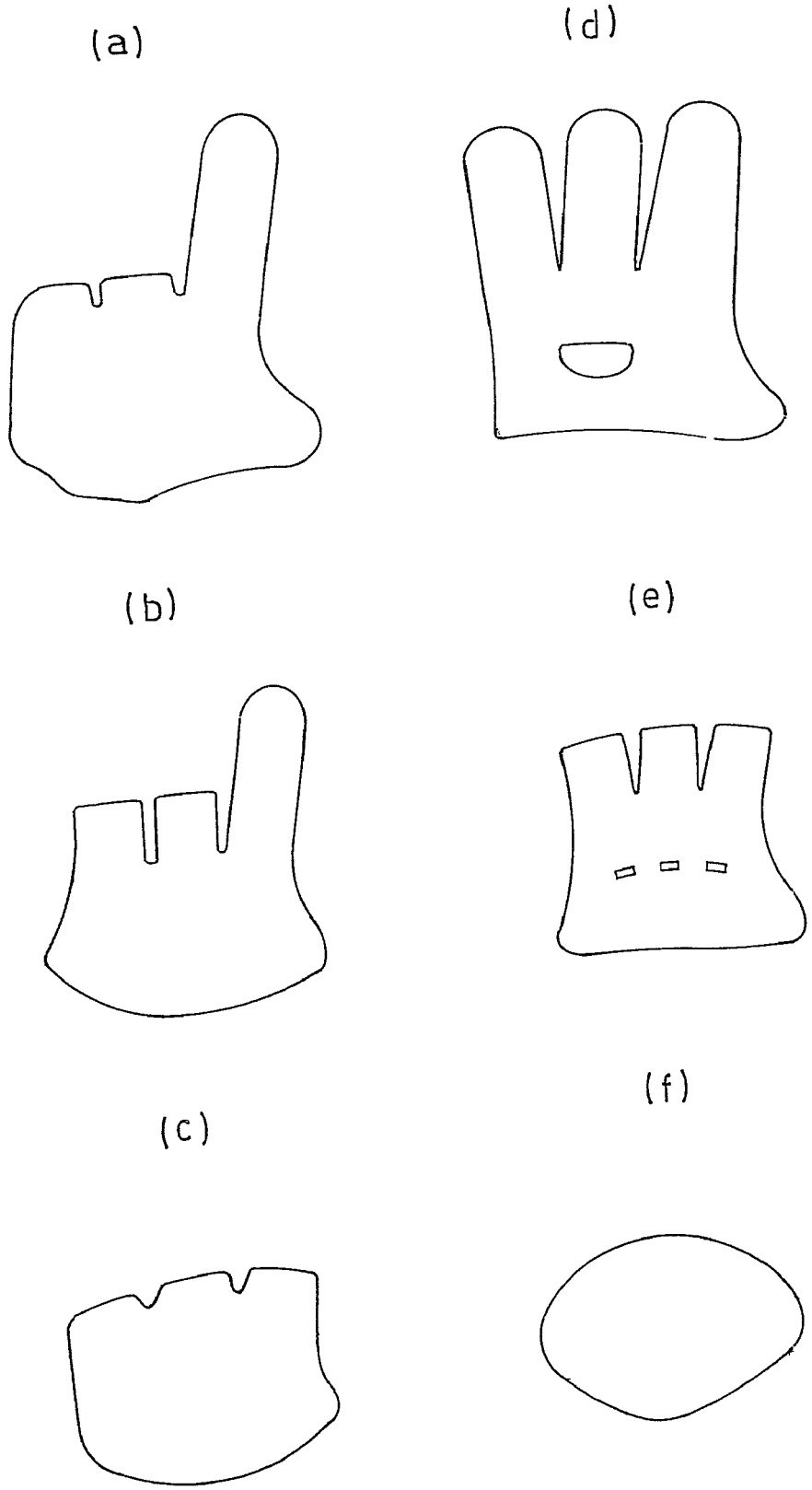

【Fig 14】
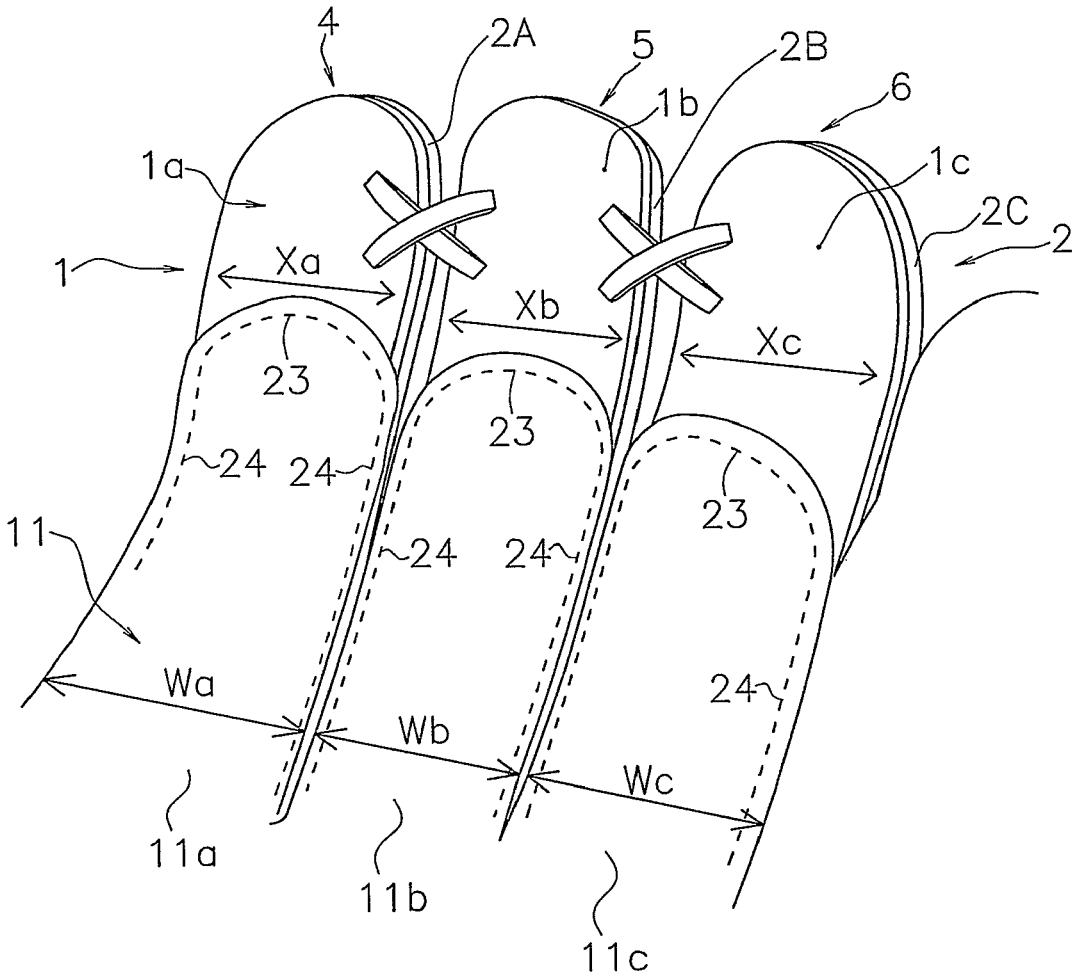

【Fig 15】
(a)
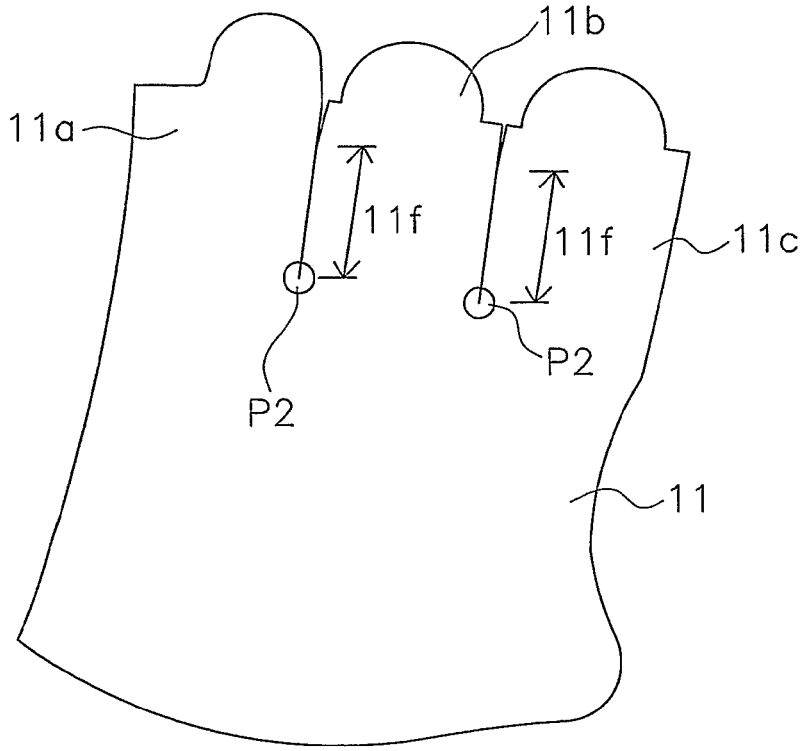
(b)
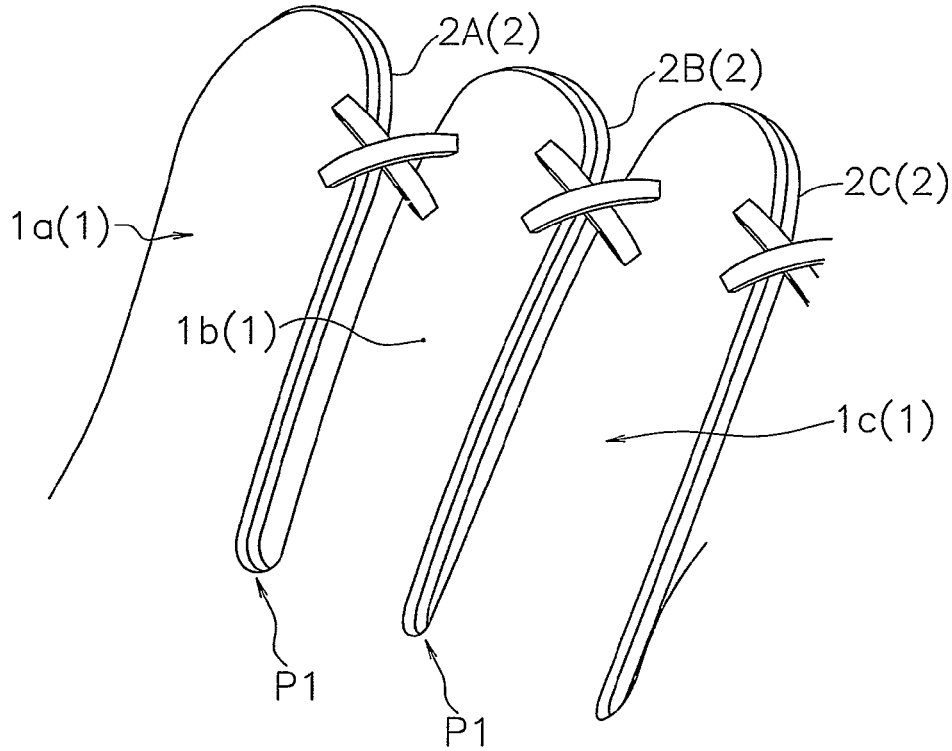

【Fig 16】
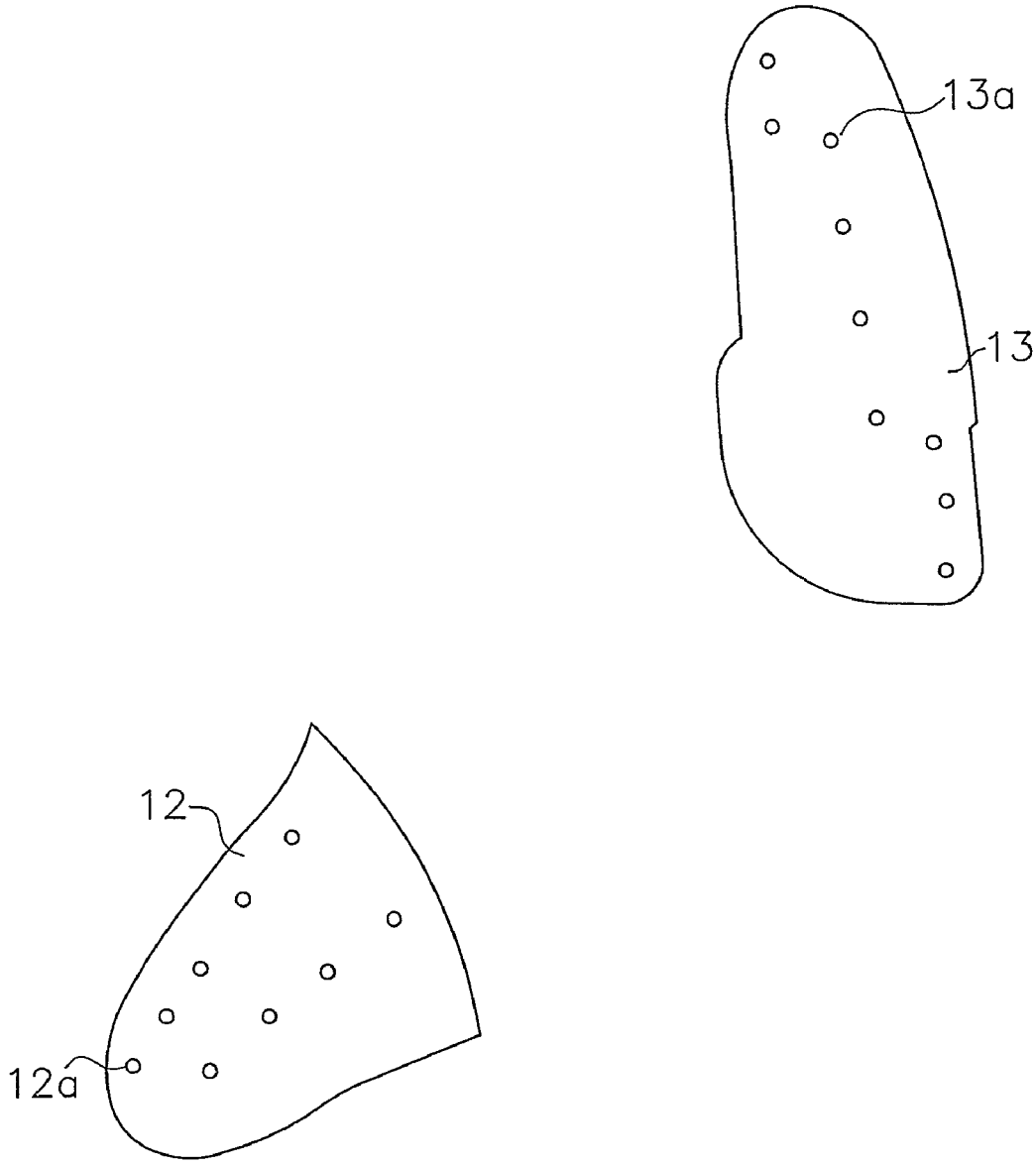

【Fig 17】
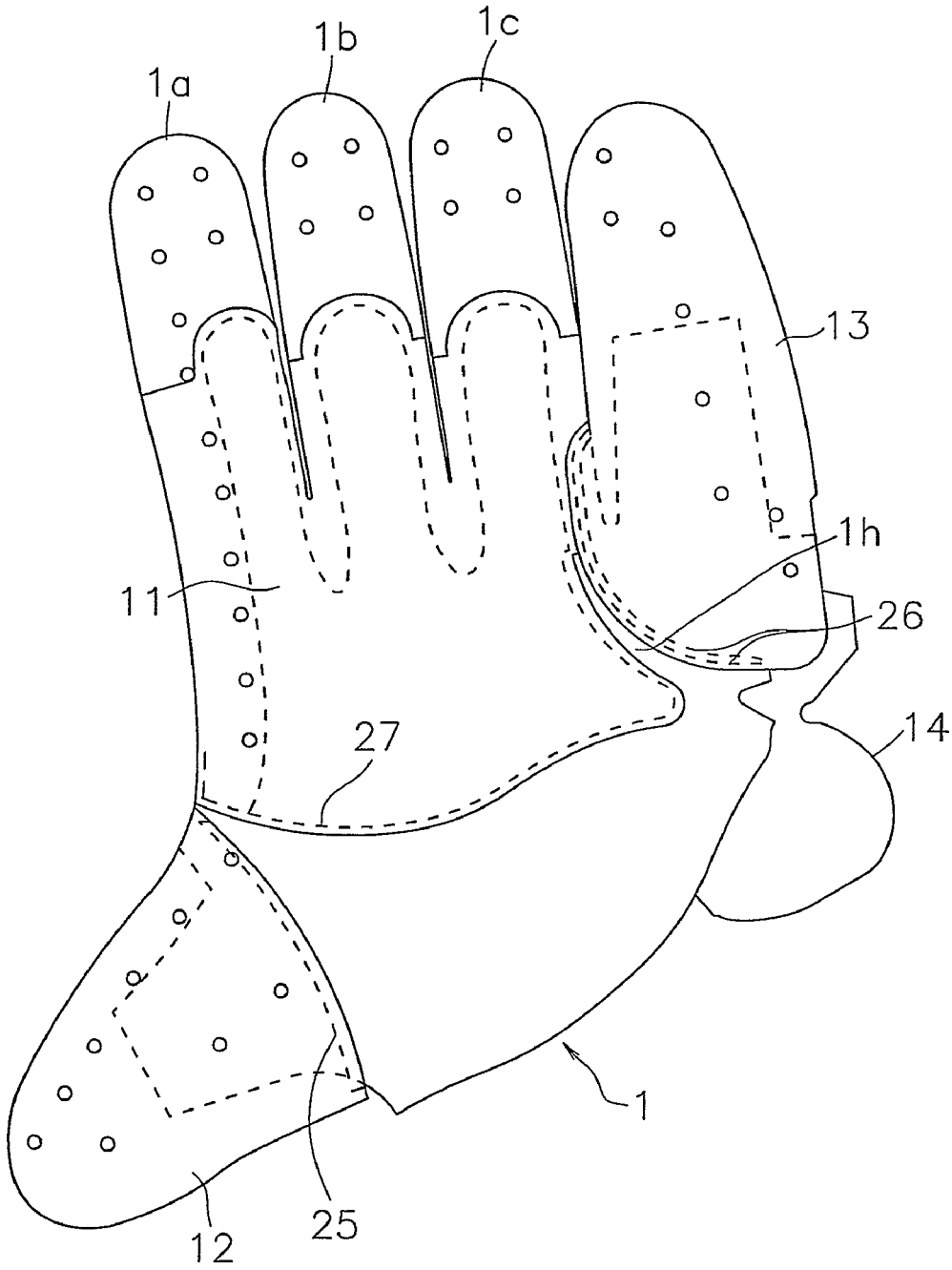

【Fig 18】
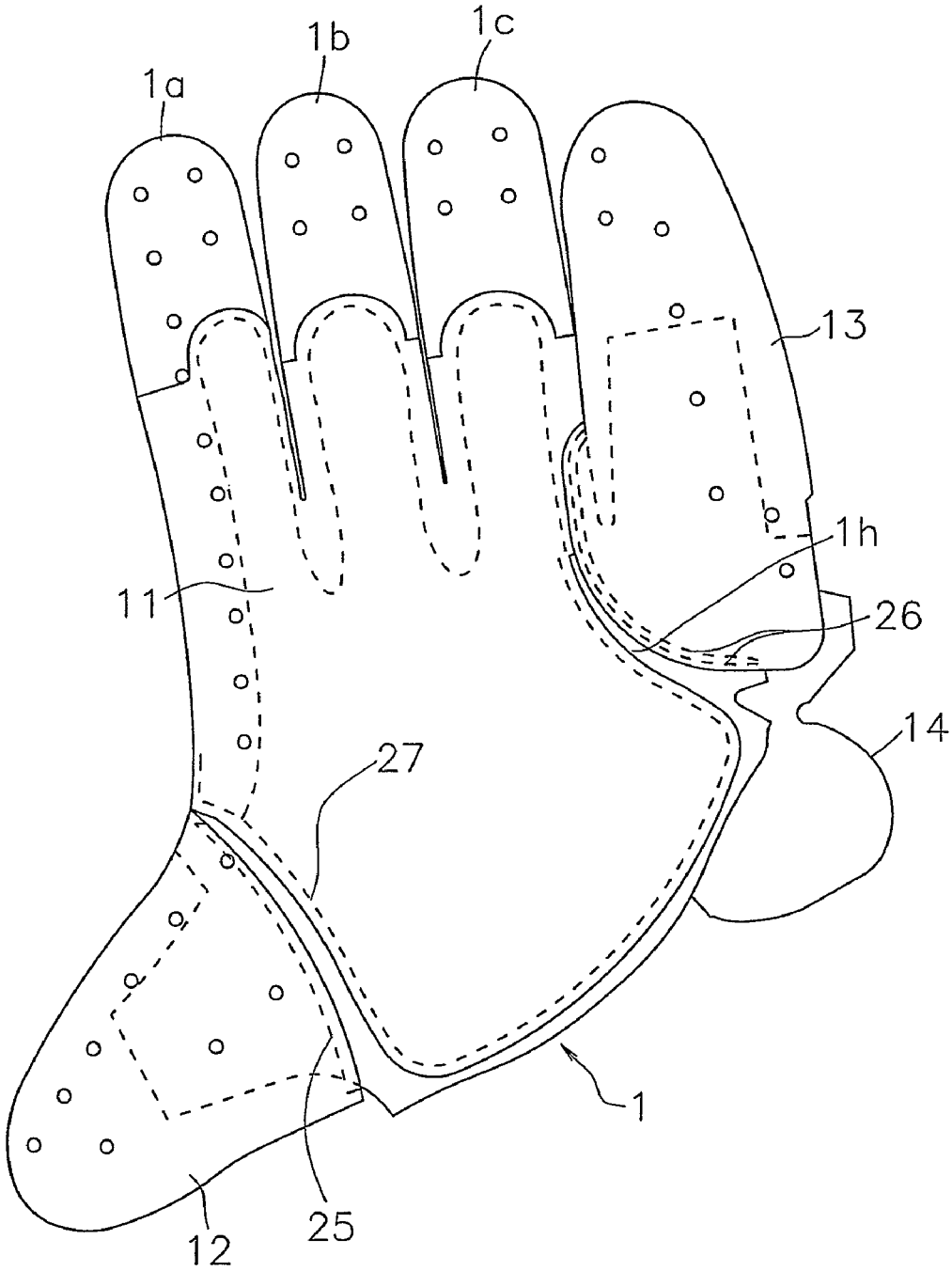

【Fig 19】
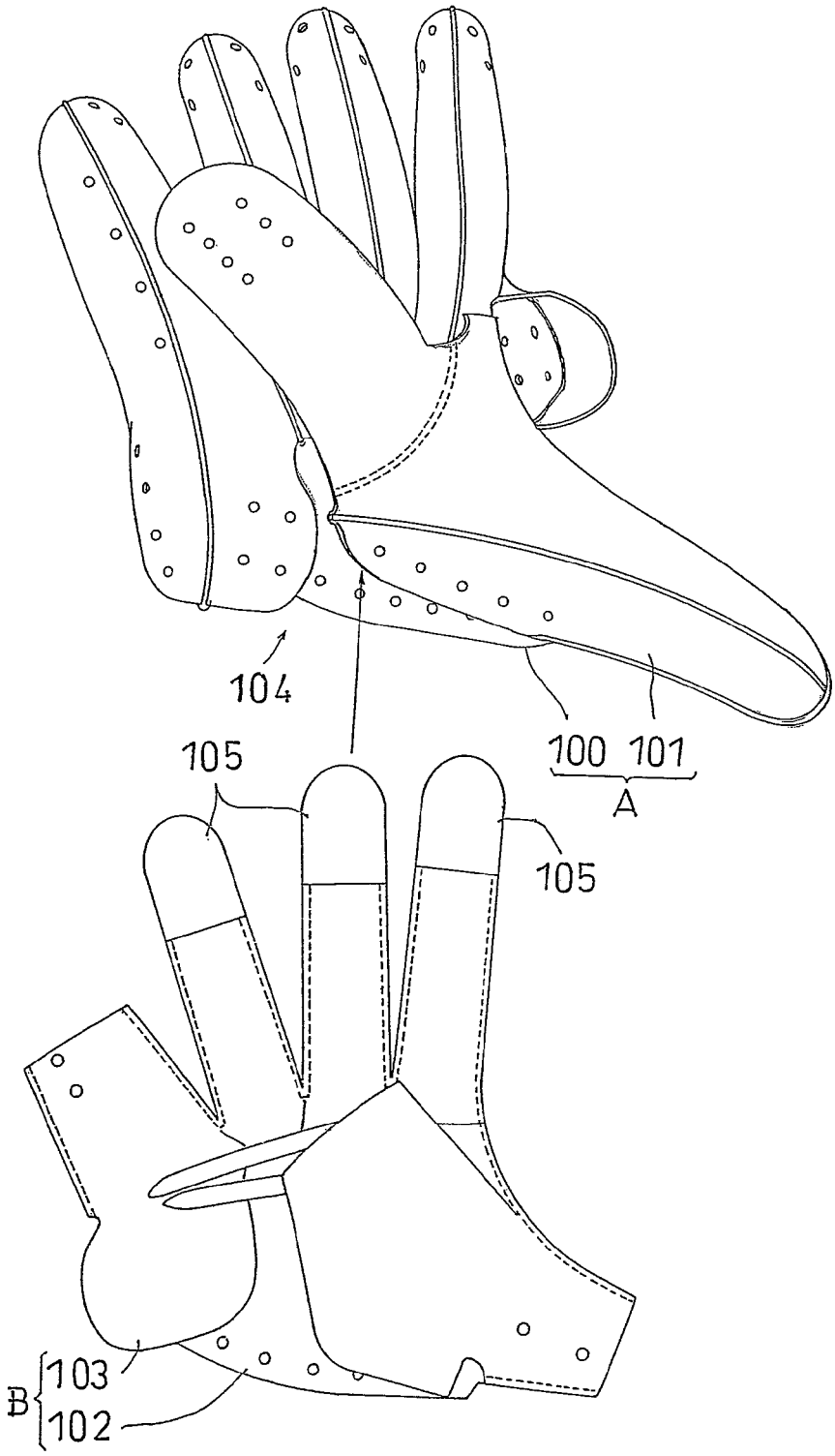

GLOVE

CROSS-REFERENCE TO RELATED APPLICATIONS

This application is a continuation-in-part of U.S. patent application Ser. No. 11/733,856, filed Apr. 11, 2007, the disclosure of which is herein incorporated by reference in its entirety.

BACKGROUND OF THE INVENTION

1. Field of the Invention

The present invention relates to a glove, and particularly to a glove used for baseball.

2. Description of the Related Art

FIG. 19 shows a general constitution of a glove used for baseball or the like. The glove includes an outer bag A of an appearance side thereof and an inner bag B accommodated in the outer bag A. The outer bag A is constituted by a palm-side outer skin 100 and a back-side outer skin 101. The inner bag B is constituted by a palm-side inner skin 102 and a back-side outer skin 103. The outer bag A has a finger inserting inlet 104, which is formed at the wrist side and from which the inner bag B is inserted. The finger inserting inlet 104 is sewn using a string to complete the glove. Felt cores are attached to the outer surface side of the-palm-side inner skin 102 of the inner bag B into which a index finger, a middle finger and a ring finger are inserted.

When such a glove catches a ball, the palm-side outer skin, the palm-side inner skin, and a space part formed between the palm-side outer skin and the palm-side inner skin are interposed between a ball receiving surface which directly catches the ball and a palm. Therefore, the glove hardly fitted comfortably in one's hand easily in catching the ball, and athletes could not be satisfied with a feeling when catching the ball. Since the outer skin and the inner skin existed between the palm and the ball receiving surface, the weight of the glove was inevitably heavy.

Preference of a fit feeling in catching the ball is different according to the athlete, and it is preferable that this can be changed according to preference of the athlete.

SUMMARY OF THE INVENTION

The present invention has been accomplished in view of the above circumstances, and it is an object of the present invention to provide a glove capable of providing good feeling when catching the ball and of reducing the whole weight thereof.

It is another object of the present invention to provide a glove capable of changing the fit feeling in catching the ball according to preference of the athlete.

In order to solve the above problems, a glove according to the present invention includes:

- a palm-side outer skin having contours partially corresponding to contours of the ball-catching glove;
- a back-side outer skin having contours partially corresponding to the contours of the palm-side outer skin; and
- a back-side inner skin having contours smaller than the contours of the palm-side outer skin, wherein a finger inserting space part into which a finger can be inserted between an inner surface of the back-side inner skin and an inner surface of the palm-side outer skin is constituted by sewing the back-side inner skin on an inner surface of the palm-side outer skin.

According to the glove having this constitution, the back-side inner skin is sewn on the inner surface of the palm-side outer skin, and the finger inserting space part into which the fingers of a hand can be inserted is formed between the inner surface of the back-side inner skin and the inner surface of the palm-side outer skin. That is, the glove does not use the palm-side inner skin used in the conventional one. Therefore, only the palm-side outer skin exists between the inserted palm and the ball receiving surface. That is, since the non-existence of the palm-side inner skin increases the adhesion degree of the glove to the palm in catching the ball, the glove fits comfortably in one's hand easily. Furthermore, the non-existence of the palm-side inner skin can reduce the whole weight of the glove.

The finger inserting space part according to the present invention is preferably a space part into which the index finger, the middle finger and the ring finger are inserted.

It is preferable that the palm-side inner skin and the palm-side outer skin exist in a space part into which the thumb and the little finger are inserted in order to ensure catching of the ball. Then, the elimination of the palm-side inner skin in the space part into which the index finger, the middle finger and the ring finger are inserted increases the adhesion degree of the glove to the palm in catching the ball, and the glove fits comfortably in one's hand easily. In addition, the elimination can maintain the original function for securely catching the ball.

In the present invention, the outer surface side of the palm-side outer skin is preferably composed of a first area where a thumb part is further sewn on the outer surface side, a second area where a little finger part is further sewn on the outer surface side, and the other third area.

According to this constitution, the thumb and little finger parts have the two-sheet constitution of an outer skin and inner skin as usual. The index, middle and ring finger parts other than the thumb part and the little finger part have the one-sheet constitution. Thereby, the constitution increases the adhesion degree of the glove to the palm in catching the ball, and makes the glove fit comfortably in one's hand easily. In addition, the constitution can enhance a catch feeling.

In the present invention, it is preferable that a patch is closely attached to a ball receiving part of the palm-side outer skin.

The attachment of the patch can change a fit feeling or the like in catching the ball to form a catch region fitting to preference of individual athletes on the glove. Since the patch is closely attached to the ball receiving part, the durability of the glove can be enhanced while the catch feeling thereof is maintained.

The patch according to the present invention is preferably attached to a region into which the index finger, the middle finger and the ring finger are inserted.

Thereby, the adhesion degree of the globe to the palm in catching the ball is increased, and the glove fits comfortably in one's hand easily.

In addition, the fit feeling in catching the ball is easily changed according to preference of individual athletes by the material, thickness and hardness or the like of the patch.

In the present invention, the patch is preferably closely attached to the third area of the palm-side outer skin.

According to this constitution, the fit feeling in catching the ball is easily changed according to preference of individual athletes by the material, thickness and hardness or the like of the patch.

A cut is preferably made in the patch according to the present invention.

The flexibility of the patch is enhanced by making the cut, and thereby the fit feeling in catching the ball can be further enhanced. The cut can be formed into an optional shape such as a line and a point, and the catch region fitting to preference of the athlete is easily formed on the glove.

In the present invention, it is preferable that a patch is closely attached to a region including a ball receiving part of the palm-side outer skin.

The attachment of the patch to the region including the ball receiving part can change a fit feeling or the like in catching the ball to form a catch region fitting to preference of individual athletes on the glove.

Since the patch is closely attached to the ball receiving part, the durability of the glove can be enhanced while the catch feeling thereof is maintained.

It is preferable that a patch of the present invention has a first region, a second region and a third region corresponding to regions into which an index finger, a middle finger and a ring finger are inserted.

Thereby, the adhesion degree of the globe to the palm in catching the ball is increased, and the glove fits comfortably in one's hand easily. In addition, the fit feeling in catching the ball is easily changed according to preference of individual athletes by the material, thickness and hardness or the like of the patch.

In the above, it is preferable that cuts are formed between the first region and the second region and between the second region and the third region.

The flexibility of the glove can be adjusted by changing the length of the cut. The flexibility of the glove is enhanced by lengthening the cut, and the length of the cut may be set according to preference of the athlete. Since the ball receiving part is enlarged when the length of the cut is shortened, the ball receiving part having a suitable size can be formed by adjusting the length of the cut. Thereby, only the ball receiving part can be enlarged without enlarging the whole of the glove.

In the present invention, it is preferable that the patch is sewn on the back-side outer skin.

With this constitution, the patch is attached to the back-side outer skin by slightly largely producing the patch and sewing the patch on the back-side outer skin. Thereby, even if the patch is large, the patch can be certainly combined with the outer skin.

In the present invention, it is preferable that a cut is made in a part corresponding to the ball receiving part of the patch.

The flexibility of the patch is enhanced by making the cut, and thereby the fit feeling in catching the ball can be further enhanced. The cut can be formed into an optional shape such as a line and a point, and the catch region fitting to preference of the athlete is easily formed on the glove.

In the present invention, it is preferable that the finger inserting space part is a space part into which an index finger, a middle finger and a ring finger are inserted.

It is preferable that the palm-side inner skin and the palm-side outer skin exist in a space part into which the thumb and the little finger are inserted in order to ensure catching of the ball. Then, the elimination of the palm-side inner skin in the space part into which the index finger, the middle finger and the ring finger are inserted increases the adhesion degree of the glove to the palm in catching the ball, and the glove fits further comfortably in one's hand easily. In addition, the elimination can maintain the original function of securely catching the ball.

In the present invention, it is preferable that the outer surface side of the palm-side outer skin is constituted by a first area where a thumb finger part is further sewn on the outer surface side, a second area where a little finger part is further sewn on the outer surface side, and other third area.

With this constitution, the thumb and little finger parts have the two-sheet constitution of an outer skin and inner skin as usual. The index, middle and ring finger parts other than the thumb part and the little finger part have the one-sheet constitution. Thereby, the constitution increases the adhesion degree of the glove to the palm in catching the ball, and makes the glove fit comfortably in one's hand easily. In addition, the constitution can enhance a catch feeling.

In the above, it is preferable that the third area forms a palm-side region of an inserting inlet into which a finger is inserted.

In the usual glove, the thumb finger part forms the palm-side region of the inserting inlet. As described above, the palm-side region of the inserting inlet is formed by the third area of the palm-side outer skin, and thereby parts combined by strings can be reduced.

BRIEF DESCRIPTION OF THE DRAWINGS

FIG. 1 is an appearance view of a glove according to an embodiment of the present invention, the glove viewed from a palm side thereof;

FIG. 2 is an appearance view of a glove according to an embodiment of the present invention, the glove viewed from a back side thereof;

FIG. 3 is a plan view of a palm-side outer skin viewed from an outer surface side thereof (ball receiving surface side);

FIG. 4 is a plan view showing a thumb part and little finger part which are sewn on an outer surface side of a palm-side outer surface;

FIG. 5 is a plan view of a palm-side outer skin shown in FIG. 3, the palm-side outer skin viewed from the inner surface side thereof;

FIG. 6 is a plan view showing a state where a thumb part, a little finger part and a back-side inner skin are sewn on a palm-side outer skin, viewed from the outer surface side;

FIG. 7 is a plan view of members shown in FIG. 6, the members viewed from the inner surface side thereof;

FIG. 8 is a plan view showing a back-side outer skin;

FIG. 9 shows a state where a back-side outer skin unit and a palm-side outer skin unit are incorporated;

FIG. 10 shows an incorporated unit with the inside and outside thereof reversed;

FIG. 11 shows the constitution of a felt core;

FIG. 12 shows a patch according to another embodiment of the present invention;

FIG. 13 shows a patch according to another embodiment of the present invention; and FIG. 14 is an appearance view of a glove using a patch according to another embodiment, the glove viewed from a palm side thereof.

FIGS. 15A and 15B are a plan view of a patch according to another embodiment.

FIG. 16 shows another embodiment of a thumb finger part and little finger part.

FIG. 17 shows the shape of a palm-side outer skin when using parts shown in FIG. 16.

FIG. 18 shows a modification of FIG. 17.

FIG. 19 shows the constitution of a conventional glove.

DETAILED DESCRIPTION OF THE PREFERRED EMBODIMENTS

Preferred embodiments of a glove according to the present invention will be described with reference to the drawings.

FIG. 1 is an appearance view of a glove according to an embodiment of the present invention, the glove viewed from a palm side thereof. FIG. 2 is an appearance view of a glove viewed from a back side thereof.

<Constitution of Glove>

As shown in FIG. 1, in this glove, an outer bag is constituted by sewing a palm-side outer skin 1 of a ball receiving surface side on a back-side outer skin 2. The glove has a thumb part 3, a index finger part 4, a middle finger part 5, a ring finger part 6 and a little finger part 7. Furthermore, the glove has a web 8 through which the thumb part 3 is connected with the index finger part 4. On the center of the palm side of the glove, there is provided a ball receiving surface 10. On the ball receiving surface 10, a patch 11 is sewn.

The glove has a fundamental appearance constitution which is not greatly changed from that of a conventional one. However, the glove has an inner constitution different from that of the conventional one, and has only a member equivalent to the palm-side outer skin without having a member equivalent to a palm-side inner skin. The glove has a constitution different from that of the conventional one in that the patch 11 is provided. These will be described below.

FIG. 3 is a plan view of a palm-side outer skin 1 viewed from an outer surface side thereof (ball receiving surface side). FIG. 4 is a plan view showing a thumb part 12 and little finger part 13 which are sewn on an outer surface side of a palm-side outer skin 1. FIG. 5 is a plan view of a palm-side outer skin 1 shown in FIG. 3, the palm-side outer skin viewed from the inner surface side thereof. FIG. 6 is a plan view showing a state where a thumb part 12, a little finger part 13 and a back-side inner skin 14 are sewn on the palm-side outer skin 1, viewed from the outer surface side thereof. FIG. 7 is a plan view of members shown in FIG. 6, the members viewed from the inner surface side thereof.

As shown in FIG. 3, the palm-side outer skin 1 has a index finger part forming region 1*a*, a middle finger part forming region 1*b* and a ring finger part forming region 1*c*. The outer surface side thereof appears in the appearance shown in FIG. 1. On these forming regions, openings 1*d* for passing a string are suitably opened.

Although a thumb part forming region 1*e* and a little finger part forming region 1*f* are also integrally formed with the other forming regions 1*a*, 1*b*, 1*c*, these do not appear in the appearance. As shown in FIG. 6, when the thumb part 12 and the little finger part 13 are sewn on the palm-side outer skin 1, the thumb part forming region 1*e* and the little finger part forming region 1*f* are located at the inner side of these parts. The thumb part 12 is sewn on the palm-side outer skin 1 by a thread 16, and the little finger part 13 is sewn on the palm-side outer skin 1 by a thread 17.

The patch 11 is superposed on the index finger part forming region 1*a*, the middle finger part forming region 1*b* and the ring finger part forming region 1*c* to integrally form a first region 11*a*, a second region 11*b* and a third region 11*c*. A ball receiving region 11*d* is formed on a part equivalent to the ball receiving surface. The patch 11, which is formed of a skin having a thickness thinner than that of the palm-side outer skin 1, is sewn so as to be stuck on the palm-side outer skin 1. The patch 11 is sewn by a thread 15 with the patch 11 stuck to the palm-side outer skin 1.

The first region 11*a*, the second region 11*b* and the third region 11*c* do not exist throughout the index finger part forming region 1*a*, the middle finger part forming region 1*b* and the ring finger part forming region 1*c*, and are formed such that the finger length becomes short.

As shown in FIG. 5, a thumb hook 18 is sewn on the inner surface side of the palm-side outer skin 1 by a thread 19. The thumb hook 18 has a bifurcated tip part 18*a*, and can stabilize the position of the thumb so that the ball is easily caught.

As shown in FIG. 6, between the thumb root side of the patch 11 and the thumb part 12, a slit-shaped clearance 1*g* is formed. This region is a region where only the palm-side outer skin 1 exists. Between the little finger root side of the patch 11 and the little finger part 13, a slit-shaped clearance 1*h* is also formed. This region is also a region where only the palm-side outer skin 1 exists.

Therefore, since the slit-shaped clearances 1*g*, 1*h* have good flexibility, the thumb part 3 and the little finger part 7 are easily bent in catching the ball, and the catch operation is easily performed. The slit-shaped clearances 1*g*, 1*h* may not be necessarily formed. For example, the patch 11 may be attached so that the patch 11 is partially superposed on the thumb part 12 and the little finger part 13.

As shown in FIG. 7, the back-side inner skin 14 is sewn on the inner surface side of the palm-side outer skin 1. By sewing the back-side inner skin 14, a index finger insert part 14*a*, a middle finger insert part 14*b*, a ring finger insert part 14*c*, a little finger insert part 14*d* and a thumb insert part 14*e* are respectively formed, which are equivalent to a finger inserting space part. The back-side inner skin 14 can be produced by using a proper material having good finger feeling.

The index finger insert part 14*a*, the middle finger insert part 14*b* and the ring finger insert part 14*c* are set to have almost the same length as those of the first region 11*a*, the second region 11*b* and the third region 11*c* of the patch 11. The little finger insert part 14*d* and the thumb insert part 14*e* are set to have almost the same length as those of the thumb part forming region 1*e* and little finger part forming region 1*f*. The index finger insert part 14*a*, the middle finger insert part 14*b* and the ring finger insert part 14*c* are sewn together with the patch 11 by the thread 15.

According to the glove described above, with respect to the index finger insert part 14*a*, the middle finger insert part 14*b* and the ring finger insert part 14*c* of the finger inserting space part, a bag-like finger insert part is formed by the inner surface side of the palm-side outer skin 1 and the inner surface side of the back-side inner skin 14.

Therefore, only the palm-side outer skin 1 and the patch 11 exist between the inserted palm and fingers, and the ball receiving surface 10. That is, since the glove has the reduced thickness, the glove fits comfortably in one's hand easily in catching the ball, and has enhanced feeling in catching the ball compared with the conventional one. Since the patch 11 is stuck to the palm-side outer skin 1 to give a feeling of integrity with the palm-side outer skin 1, the patch 11 does not deteriorate the feeling in catching the ball.

In this embodiment, although the patch 11 is provided, the patch 11 is not necessarily required. When the patch 11 is not provided, only the palm-side outer skin 1 exists between the inserted palm and the ball receiving surface 10, and the feeling in catching the ball is improved. However, the durability of the glove can be enhanced by providing the patch 11.

<Producing Process of Glove>

Next, the producing process of the glove according to the present invention will be briefly described. First, the palm-side outer skin 1, thumb part 12, little finger part 13 and patch 11 shown in FIG. 3 are separately produced. Since the index finger part forming region 1*a*, middle finger part forming region 1*b* and ring finger part forming region 1*c* of the palm-side outer skin 1 appears in the appearance in producing the palm-side outer skin 1, the thumb part 12, the little finger part 13 and the patch 11, they are produced in a size corresponding thereto. Since the thumb part forming region 1*e* and the little finger part forming region 1*f* are accommodated in the glove, they are produced in a size smaller than those of the thumb part 12 and little finger part 13. The above members are joined together in forms as shown in FIGS. 6, 7. The members shown in FIGS. 6, 7 are referred to as a "palm-side outer skin unit" for the sake of convenience of the description.

In the above description, the thumb part forming region 1*e*, the little finger part forming region 1*f* and the other region are respectively equivalent to a first area, a second area and a third area.

Next, the back-side outer skin 2 is prepared. FIG. 8 shows the back-side outer skin 2. As shown in FIG. 8(*a*), the back-side outer skin 2 is produced in a shape as shown in FIG. 8(*b*) by sewing a plurality of parts 2*a*. The back-side outer skin 2 is the same as the conventional one. FIG. 8 is a plan view of the back-side outer skin 2 viewed from the appearance side (outer surface side).

The back-side outer skin 2 shown in FIG. 8 is then incorporated with the palm-side outer skin unit shown in FIG. 7. FIG. 9(*a*) shows a state where the palm side of the back-side outer skin 2 is superposed and sewn on the palm side shown in FIG. 6. FIG. 9(*b*) shows a state where the state shown in FIG. 9(*a*) is turned over. That is, referring to a joint unit shown in FIG. 9, a part to be the appearance is located at the inner side, and a part to be the inner surface is located at the outer side.

Then, the joint unit of FIG. 9 is turned so that the inner side thereof becomes the outer side and the outer side becomes the inner side. The joint unit after being subjected to the work, which is shown in FIG. 10, is almost a glove in the final shape.

FIG. 11 shows reinforcing felt cores to be inserted into the index finger part 4, the middle finger part 5 and the ring finger part 6, which are respectively a felt core 20 for the index finger, a felt core 21 for the middle finger and a felt core 22 for ring finger. These felt cores 20, 21, 22 are inserted into a clearance between the inner surface side of the back-side outer skin 2 and the outer surface side of the back-side inner skin 14. On the felt cores 20, 21, 22, openings 20*a*, 21*a*, 22*a* for passing a string are respectively formed, and the felt cores 20, 21, 22 are integrally combined by a string 9 as shown in FIG. 1.

The felt cores 20, 21, 22 are conventionally inserted into the space between the palm-side outer skin 1 and the palm-side inner skin. However, since the palm-side inner skin does not exist in the present invention, the felt cores are inserted into the above described place.

After combining the felt cores 20, 21, 22, the parts are combined using the string to complete the glove as a product. Since the process is the same as the conventional one, the description thereof is omitted.

<Another Embodiment of Patch>

FIG. 14 shows another embodiment of a patch 11. A first region 11*a*, a second region 11*b* and a third region 11*c* of the patch 11 are formed so as to correspond to an index finger part forming region 1*a*, a middle finger part forming region 1*b* and a ring finger part forming region 1*c* of a palm-side outer skin 1. In the embodiment described in FIG. 3 or the like, the widths Xa, Xb and Xc of the index finger part forming region 1*a*, the middle finger part forming region 1*b* and the ring finger part forming region 1*c* are set larger than the widths Wa, Wb and Wc of the first region 11*a*, the second region 11*b* and the third region 11*c*.

In the embodiment shown in FIG. 14, conversely, the patch 11 is slightly largely formed so that the widths Wa, Wb and Wc of the first region 11*a*, the second region 11*b* and the third region 11*c* are a little larger than the widths Xa, Xb and Xc of the index finger part forming region 1*a*, the middle finger part forming region 1*b* and the ring finger part forming region 1*c*.

The patch 11 is sewn on the palm-side outer skin 1 with a thread 23 and both the width parts thereof are sewn on the back-side outer skin 2 with a thread 24. That is, the first region 11*a*, the second region 11*b* and the third region 11*c* of the patch 11 are sewn on the index finger part forming region 2A, the middle finger part forming region 2B and the middle finger part forming region 2C in the back-side outer skin 2 with the thread 24.

Thus, the size of a pocket can be enlarged without enlarging the whole size of the glove by slightly largely forming the patch 11. That is, the pocket can be advantageously enlarged regardless of the size of the glove by enlarging only the patch 11.

FIG. 15A is a plan view showing the shape of a patch 11 according to another embodiment. FIG. 15B shows a partial appearance of a palm side of a glove before the patch 11 is attached. The patch 11 shown herein is divided into a first region 11*a*, a second region 11*b* and a third region 11*c* by forming a cuts 11*f*. The depth of this cut 11*f* can be optionally determined, and the flexibility of the ball receiving surface can be adjusted by the depth of the cut 11*f*. That is, it not to be necessary to determine the length of the cut 11*f* according to the shapes of a index finger part forming region 1*a*, a middle finger part forming region 1*b* and a ring finger part forming region 1*c* of the palm-side outer skin 1. In some cases, the length of the cut 11*f* can be considerably shortened.

If the length of the cut 11*f* is shortened, the pocket can be enlarged. If the length of the cut 11*f* is lengthened, the pocket is reduced, but the flexibility thereof is increased.

Root parts of the glove both between the index finger part forming region 1*a* and the middle finger part forming region 1*b*, and between the middle finger part forming region 1*b* and the ring finger part forming region 1*c* are indicated by P1. Root parts of the cut 11*f* are indicated by P2. The root part P1 and the root part P2 may not be at the same position, and as described above, both the root parts are at different positions by setting the length of the cut 11. The patch 11 of the part in which the cut 11*f* is formed can be sewn on the back-side outer skin 2 by a thread (the same as that of the thread 24 in FIG. 14).

<Palm-Side Outer Skin and Another Embodiment of Part>

FIG. 16 shows another embodiment of a thumb finger part 12 and a little finger part 13. FIG. 17 shows the shape of the palm-side outer skin 1 when using the parts shown in FIG. 16. As compared with the embodiment of FIG. 4, the size of the thumb finger part 12 is considerably reduced. In FIG. 4, a palm-side region of an inserting inlet E into which a finger is inserted is formed by the thumb finger part 12. However, in FIG. 17, the palm-side region of the inserting inlet E is formed by the third area of the side outer skin 1. Incidentally, in any case, the back-side region of the inserting inlet E is formed by the back-side outer skin 2.

The thumb finger part 12 is sewn on the palm-side outer skin 1 by a thread 25. As can be seen from the comparison with FIG. 4, the number of holes 12*a* for tying a string is reduced.

The shape of the little finger part 13 is almost the same as that shown in FIG. 4. However, the little finger part 13 is combined with the palm-side outer skin 1 by a thread 26, and the number of a holes 13*a* for tying the string is reduced. The patch 11 is combined with the palm-side outer skin 1 with a thread 27. As described above, a method for combining the patch 11 with the back-side outer skin 2 may be adopted.

FIG. 18 shows a modification of FIG. 17, and FIG. 18 shows an example in which the size of a ball receiving surface of the patch 11 is enlarged. Thus, the size of the patch 11 can be suitably changed.

Still Another Embodiment

Although the patch 11 is sewn and attached on the palm-side outer skin 1 or the back-side outer skin 2 in this embodiment, the patch 11 may be stuck thereto using an adhesives or the like in place of sewing. A joint method combining sewing with an adhesive may be adopted.

As shown in FIG. 12, cuts 11*e* may be made in the patch 11. Thereby, the flexibility of the glove is improved, and the glove easily holds the ball. The direction of the cut 1*e* can be set in the proper direction in consideration of operability. The cut can be formed into optional shapes such as a point (circle), a long circle and a rectangle besides the shape illustrated in FIG. 12, and thereby the catch region fitting to preference of the athlete is easily formed on the glove.

The shape of the patch 11 is not limited to that shown in FIG. 12, and various modifications can be considered. FIG. 13 shows the modifications. FIGS. 13(*a*), 13(*b*) and 13(*c*) show examples in which the length of finger part is changed. FIGS. 13(*d*) and 13(*e*) show examples in which a cut shape is different from that of FIG. 12. FIG. 13(*f*) shows an example in which the shape of the finger part does not exist.

What is claimed is:

1. A ball-catching glove comprising:

a palm-side outer skin having a palm-side surface and back-side surface, and having contours partially corresponding to contours of the ball-catching glove;

a back-side outer skin having a palm-side surface and back-side surface, and having contours partially corresponding to the contours of the palm-side outer skin;

a back-side inner skin having a palm-side surface and back-side surface, and having contours smaller than the contours of the palm-side outer skin, a web through which a thumb part is connected with an index finger part, a patch closely attached to a ball receiving part of the palm-side outer skin, and a slit-shaped clearance formed between a thumb root side of the patch and the thumb part extending to the bottom of the little finger part, whereby the palm-side outer skin is presented in the clearance as a single layer, wherein a portion along the contours of the back-side inner skin is sewn together with the palm-side outer skin to form a finger inserting space part for inserting fingers between an inner surface of the back-side inner skin and an inner surface of the palm-side outer skin facing each other and sewn together, and a portion along the contours of the back-side outer skin is sewn together with a portion along the contours of the palm-side outer skin, enclosing therebetween the back-side inner skin.

2. The glove according to claim 1, wherein the finger inserting space part is a space part into which an index finger, a middle finger and a ring finger are inserted.

3. The glove according to claim 1, wherein the outer surface side of the palm-side outer skin is constituted by a first area where the thumb part is further sewn on the outer surface side, and a second area where a little finger part is further sewn on the outer surface side, and a third area where the rest of the outer surface side of the palm-side outer skin is.

4. The glove according to claim 3, wherein the patch extends across a third area of the palm-side outer skin which is a middle area between the first and second areas.

5. The glove according to claim 4, wherein the patch has a thickness thinner than a thickness of the palm-side outer skin.

6. The glove according to claim 4, wherein a cut is made in the patch.

7. The glove according to claim 1, wherein the patch extends across a region into which a index finger, a middle finger and a ring finger are inserted.

8. The glove according to claim 1, wherein the patch extends across a region including a ball receiving part of the palm-side outer skin.

9. The glove according to claim 8, wherein the patch has a first region, a second region and a third region corresponding to regions into which an index finger, a middle finger and a ring finger are inserted.

10. The glove according to claim 9, wherein cuts are formed between the first region and the second region and between the second region and the third region.

11. The glove according to claim 8, wherein the patch is sewn on the palm-side outer skin.

12. The glove according to claim 8, wherein a cut is made in a part corresponding to the ball receiving part of the patch.

13. The glove according to claim 8, wherein the finger inserting space part is a space part into which an index finger, a middle finger and a ring finger are inserted.

14. The glove according to claim 8, wherein the outer surface side of the palm-side outer skin is constituted by a first area where the thumb finger part is further sewn on the outer surface side, a second area where a little finger part is further sewn on the outer surface side, and a third area where the rest of the outer surface side of the palm-side outer skin is.

15. The glove according to claim 14, wherein the third area forms a palm-side region of an inserting inlet into which a finger is inserted.

16. The glove according to claim 9, wherein the portion of the palm-side outer skin present as a single layer comprises said first region, second region, and third region.

17. The glove according to claim 1, further comprising a slit-shaped clearance is provided between the patch and the little finger part.

* * * * *

UNITED STATES PATENT AND TRADEMARK OFFICE

CERTIFICATE OF CORRECTION

PATENT NO. : 7,841,017 B2
APPLICATION NO. : 12/014732
DATED : November 30, 2010
INVENTOR(S) : Akio Aoki It is certified that error appears in the above-identified patent and that said Letters Patent is hereby corrected as shown below:

In Column 9, Line 17, Change "1e" to --11e--.

Signed and Sealed this
Seventeenth Day of January, 2012

David J. Kappos

David J. Kappos
*Director of the United States Patent and Trademark Office*